US008884869B2

(12) United States Patent
Tsai et al.

(10) Patent No.: US 8,884,869 B2
(45) Date of Patent: Nov. 11, 2014

(54) COURT BORDER MODULE USING DISPLAY APPARATUS

(75) Inventors: Yao-Chou Tsai, Hsinchu (TW); Fang-An Shu, Hsinchu (TW); Chia-Chun Yeh, Hsinchu (TW); Ted-Hong Shinn, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 147 days.

(21) Appl. No.: 13/612,864

(22) Filed: Sep. 13, 2012

(65) Prior Publication Data

US 2013/0187900 A1 Jul. 25, 2013

(30) Foreign Application Priority Data

Jan. 19, 2012 (TW) ..... 101102207 A

(51) Int. Cl.
*G09G 3/34* (2006.01)
*A63C 19/06* (2006.01)

(52) U.S. Cl.
USPC ..... 345/107; 473/467

(58) Field of Classification Search
USPC ..... 345/84, 85, 107, 211; 359/228, 296; 473/467, 570
See application file for complete search history.

(56) References Cited

U.S. PATENT DOCUMENTS 4,538,811 A * 9/1985 Wigoda ..... 473/467
4,855,711 A 8/1989 Harrop et al.
5,394,824 A * 3/1995 Johnson, Jr. ..... 116/203
7,342,556 B2 * 3/2008 Oue et al. ..... 345/33
2006/0287140 A1 * 12/2006 Brandt et al. ..... 473/467
2009/0143174 A1 6/2009 Brandt et al.
2011/0239790 A1 * 10/2011 Kuczynski et al. ..... 73/862.624
2013/0017948 A1 * 1/2013 Charlson et al. ..... 503/201

FOREIGN PATENT DOCUMENTS

CN 1459072 A 11/2003
CN 101284175 A 10/2008
CN 101840290 A 9/2010
CN 101893801 A 11/2010
TW 200938926 A 9/2009
TW 201039889 A 11/2010

OTHER PUBLICATIONS

Corresponding TW Office Action.
The Exploit of Intelligent Side line of Sports Competition Area, Song Qinghua, Journal of Jilin Institute of Physical Education, 2010 vol. 26 No. 3.
Corresponding CN Office Action that these art references were cited, Aug. 29, 2014.

* cited by examiner

*Primary Examiner* — Rodney Amadiz
(74) *Attorney, Agent, or Firm* — CKC & Partners Co., Ltd.

(57) ABSTRACT

A court border module using a display apparatus is disclosed, which uses piezoelectric elements to drive the display apparatus. When a ball hits a court border, which is defined by the display apparatus, a force is applied to the piezoelectric elements which then generate power to drive the corresponding part of the display apparatus. The color of the part of the display apparatus hit by the ball is switched. Therefore the change in the color of the court border can be observed by officials and others to instantly and objectively determine whether the ball has hit the court border.

9 Claims, 2 Drawing Sheets

COURT BORDER MODULE USING DISPLAY APPARATUS

RELATED APPLICATIONS

This application claims priority to Taiwan Application Serial Number 101102207, filed Jan. 19, 2012, which is herein incorporated by reference.

BACKGROUND

1. Field of Invention

The present invention relates to a court border module using a display apparatus. More particularly, the present invention relates to a court border module using a display apparatus driven by piezoelectric elements.

2. Description of Related Art

A sports official typically determines if a ball is out of bounds using his or her eyes, that is, through a visual inspection of the ball relative to a court border which is most often simply painted on the court. This may lead to some problems due to the limitations of eye precision. For example, the eyes are sometimes unable to determine the exact landing location of a fast moving ball. Recently, Hawk-Eye® is used in some ball games, such as tennis, to determine the positions of balls for officials and players. However, HawkEye® affects the tempo of the game and also the mental state of the players since it takes time for HawkEye® to process the trajectory of a ball using cameras and further utilizing ball path computer calculations. Furthermore, the results obtained using Hawk-Eye® are indirect due to the fact that the images used are acquired through calculation. In addition, there have been instances where the results obtained using Hawk-Eye® have been incorrect, making people doubt the accuracy of this system.

SUMMARY

The invention provides a court border module using a display apparatus.

In an embodiment of the invention, the court border module includes a top electrode connected to a voltage level and which defines a court border, a plurality of bottom electrodes, a display layer disposed between the top electrode and the bottom electrodes, and a plurality of piezoelectric elements. A plurality of display areas are defined between the top electrode and the bottom electrodes. The piezoelectric elements are connected to the bottom electrodes respectively. The display layer includes a plurality of microcapsules, and at least one of the microcapsules is driven to switch the color shown by the corresponding display area when a force is applied to at least one of the corresponding piezoelectric elements. Each of the microcapsules includes a plurality of white particles each having a first type of charge and a plurality of black particles each having a second type of charge. The court border module using a display apparatus may further include a transparent protective layer disposed on the top electrode, a plurality of capacitors, and a plurality of switches. Each of the capacitors connects one of the bottom electrodes and the voltage level. The switches are transistors, and each of the switches connects one of the bottom electrodes and a signal source. The polarity of a voltage supplied by the signal source is opposite the polarity of a voltage generated by the piezoelectric elements. The piezoelectric elements are disposed below the bottom electrodes. The voltage level can be a ground.

In some embodiments, each of the plurality of display areas is defined by the top electrode and one of the bottom electrodes, and the display layer includes a plurality of microcapsules, in which one or more of the microcapsules corresponds to each of the display areas and to the bottom electrode corresponding to the each of the display areas. The one or more of the microcapsules corresponding to one of the display areas is driven by the corresponding bottom electrode to switch a color shown by the corresponding display area when a force is applied to the corresponding piezoelectric element.

BRIEF DESCRIPTION OF THE DRAWINGS

The invention can be more fully understood by reading the following detailed description of the embodiments, with references made to the accompanying drawings as follows.

DETAILED DESCRIPTION

Figure 1:
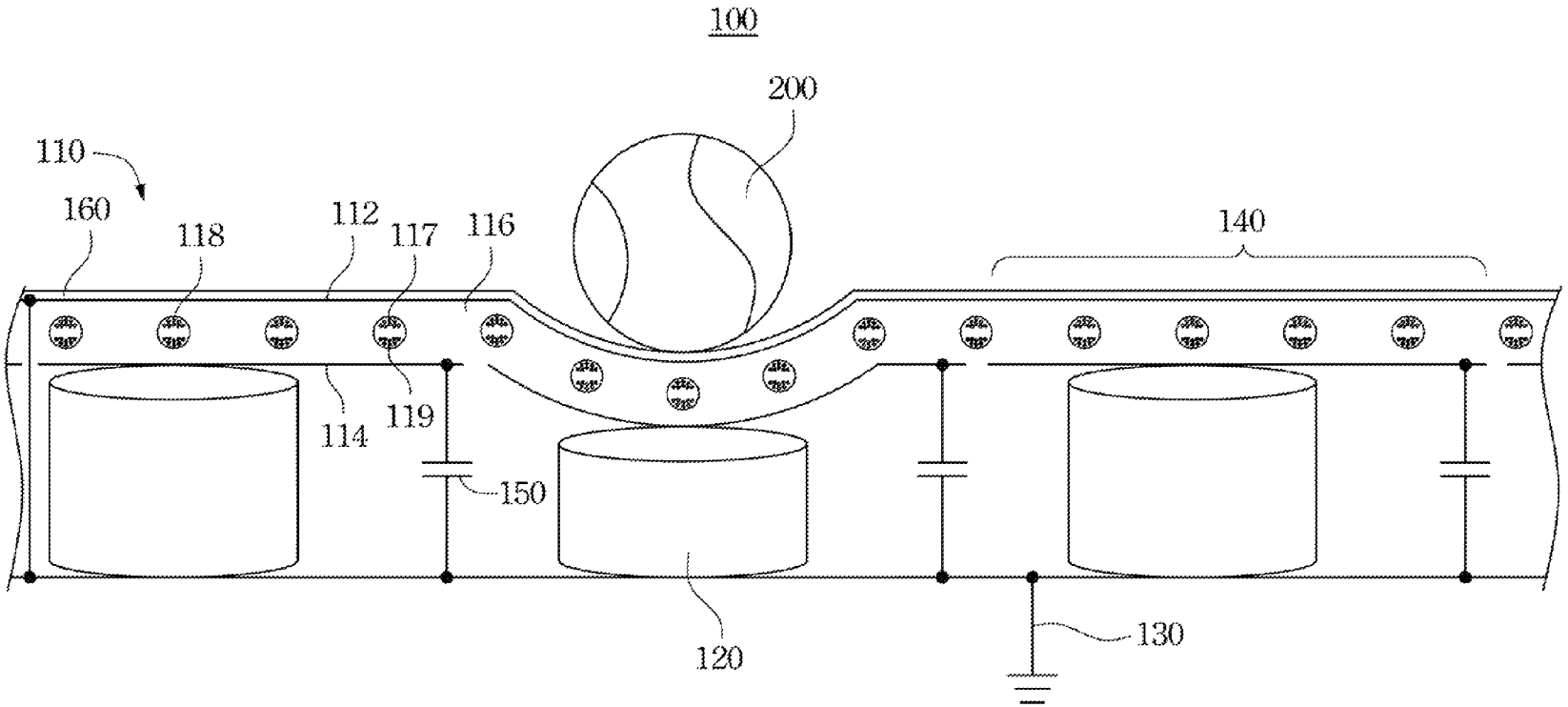
FIG. 1 is a schematic diagram of a court border module using a display apparatus according to one embodiment of this invention.

Reference will now be made in detail to the present embodiments of the invention, examples of which are illustrated in the accompanying drawings. Wherever possible, the same reference numbers are used in the drawings and the description to refer to the same or like parts. It will be apparent to those skilled in the art that various modifications and variations can be made to the structure of the present invention without departing from the scope or spirit of the invention.

This invention provides a court border module using a display apparatus. In particular, the present invention provides a court border module using a display apparatus driven by piezoelectric elements. In an embodiment of the invention, a ball applies a force to a flexible display apparatus when it hits a court border. The force makes the piezoelectric elements generate charges which are supplied to the corresponding part of the display apparatus. As a result, the display apparatus is driven to switch the color it is displaying. The display apparatus may switch the color it is displaying from white to black for instance. Therefore, a determination as to whether the ball has hit the border can be instantly and objectively made by observing the color of the border.

FIG. 1 is a schematic diagram of a court border module using a display apparatus according to one embodiment of this invention. The court border module 100 includes a display apparatus 110 and a plurality of piezoelectric elements 120. Each of the piezoelectric elements 120 has two terminals. In this embodiment, the display apparatus 110 may be a bistable display, such as an electrophoretic display. The display apparatus 110 is not limited to any particular type in this invention, and may be a different type of a bistable display in other embodiments. The display apparatus 110 includes a top electrode 112, a plurality of bottom electrodes 114, and a display layer 116. The display layer 116 is disposed between the top electrode 112 and the bottom electrodes 114. The top electrode 112 is exposed on the ground for defining the border of the court. The top electrode 112 connects to a voltage level 130, which may be a ground. In some embodiments, the display apparatus 110 displays a white color when it is not driven to thereby clearly show the court border.

The bottom electrodes 114 are disposed under the top electrode 112, and a plurality of display areas 140 are defined between the top electrode 112 and the plurality of bottom electrodes 114. In other words, the display apparatus 110 includes a plurality of display areas 140, and each of the display areas 140 is formed between one of the bottom electrodes 114 and the corresponding part of the top electrode 112. The bottom electrodes 114 connect to the voltage level 130. The display layer 116 includes a plurality of microcapsules 118. Each of the microcapsules 118 includes a plurality of white particles 117 having a first type of charge and a plurality of black particles 119 having a second type of charge. The first type of charge is opposite in polarity to the second type of charge. The black particles 119 and the white particles 117 are described only by way of example in this embodiment. In other embodiments, the microcapsules 118 may include particles having charges opposite in polarity and that are other colors.

One or a plurality of piezoelectric elements 120 are disposed corresponding to and below the bottom electrodes 114. The two terminals of each of the piezoelectric elements 120 contact the voltage level 130 and one of the bottom electrodes 114 respectively. A ball 200 exerts a force on the court border module 100 when the ball 200 hits the border defined by the top electrode 112. As a result, one or more of the piezoelectric elements 120 are pressed to thereby generate charges which are applied to the bottom electrodes 114. As a result, the microcapsules 118 in corresponding display areas 140 are affected by the generated charges, such that the corresponding display areas 140 switch color to black in this embodiment. The court border module 100 further includes a plurality of capacitors 150. The capacitors 150 connect the bottom electrodes 114 and the voltage level 130 in series in order to maintain the color-switched state in the corresponding display areas 140 longer, which allows officials and players to more easily view the change in color. The capacitors 150, which connect to the bottom electrodes 114 respectively, temporarily hold the charges provided by the piezoelectric elements 120 so that the charges are continuously applied to the corresponding bottom electrodes 14, thereby maintaining the color-switched state of the corresponding display areas 140 for a longer period of time.

More specifically, the ball 200 exerts a force on the court border module 100, that is, on the border of the court defined by the top electrode 112, and this force is transferred to at least one piezoelectric element 120. The at least one piezoelectric element 120 is pressed by this force to generate charges which are applied to the corresponding bottom electrode 114 and which charge the capacitor 150. An electric field is generated between the bottom electrode 114 and the top electrode 112 when the bottom electrode 114 reaches a certain driven voltage level. The electric field drives the corresponding microcapsules 118 in the display area 140 to switch color so that the corresponding display area 140 indicates a different color, black for example. Therefore, the portion of the border struck by the ball 200 is shown in a different color. In addition, the display area 140 may be maintained in the color-switched state a certain duration of time since the capacitor 150 continues to apply the driven voltage at the certain level to the bottom electrode 114. The court border module 100 may further include a transparent protective layer 160 disposed on the top electrode 112 (i.e., on an upper surface of the top electrode 112). The transparent protective layer 160 protects the display apparatus 110 and the capacitors 150 to avoid damage caused by the ball 200 hitting the court border module 100.

Figure 2:
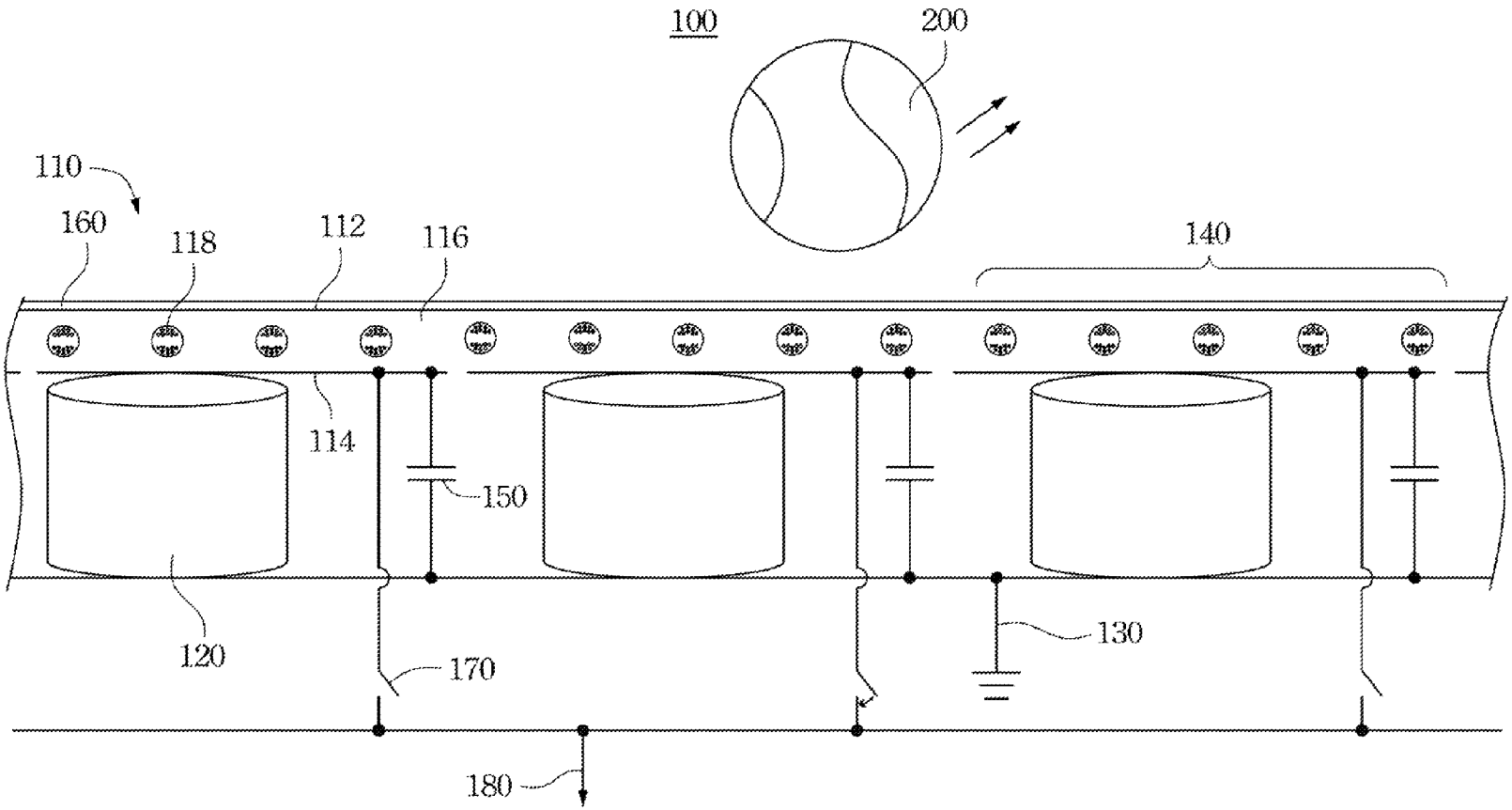
FIG. 2 is a schematic diagram of a court border module using a display apparatus according to another embodiment of this invention.

FIG. 2 is a schematic diagram of a court border module using a display apparatus according to another embodiment of this invention. In addition to the display apparatus 110, the piezoelectric elements 120, and the capacitors 150, the court border module 100 of this embodiment further includes an image-deleting device. The image-deleting device is utilized for recovering the display apparatus 110 back to the white color when a force is applied by an object other than the ball 200, such as the foot of a player placed on the court border module 100.

The image-deleting device includes a plurality of switches 170 which may be transistors. A signal source 180 connects to the bottom electrodes 114 via the switches 170. The polarity of the voltage of the signal source 180 is opposite to the polarity of the driven voltage generated by the piezoelectric elements 120. Therefore, the signal source 180 drives the display apparatus 110 to display a white color. The switch 170 connected to the bottom electrode 114 of one of the driven display areas 140 is closed when it is desired to delete the color in the driven display area 140 (i.e., in this example, when it is desired to change the black color displayed in the driven display area 140 back to white). By such closing of the switch 170, the path between the signal source 180 and the bottom electrode 114 is made conductive, which switches the polarity of the voltage applied to the bottom electrode 114 to be opposite to the polarity of the driven voltage supplied by the piezoelectric element 120. Therefore, the voltage with opposite polarity drives the microcapsules 118 located between the bottom electrode 114 and the top electrode 112 again to make them switch to white from black. As a result, the display area 140 returns to display white. In some embodiments, all of the switches 170 may be closed so as to switch the entire display apparatus 110 back to display white. The signal source 180 also may serve to supply a signal combined of positive and negative charges for removing residual images.

According to the embodiments described above, many advantages are realized through application of this invention. A court border module using a display apparatus may be applied in high-speed ball games such as tennis. Piezoelectric elements are used in the court border module to drive the display apparatus. The piezoelectric elements in the court border module generate charges when forces are applied thereto (i.e., by a ball hitting the court border defined by the display apparatus), and the charges drive the corresponding part of the display apparatus. Part of the display apparatus then switches its color, for example, from white to black. Therefore, officials and others can instantly and objectively determine if the ball has hit the border through visual observation of the color of the border.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A court border module using a display apparatus comprising:

a top electrode for defining a court border, the top electrode connecting to a voltage level;

a plurality of bottom electrodes, wherein a plurality of display areas are defined between the top electrode and the bottom electrodes;

a display layer disposed between the top electrode and the bottom electrodes;

a plurality of piezoelectric elements connected to the bottom electrodes respectively; and a plurality of capacitors each connecting one of the bottom electrodes and the voltage level.

2. The court border module using a display apparatus of claim 1, wherein the display layer comprises a plurality of microcapsules, and at least one of the microcapsules is driven to switch a color shown by the corresponding display area when a force is applied to at least one of the corresponding piezoelectric elements.

3. The court border module using a display apparatus of claim 2, wherein each of the microcapsules comprises a plurality of white particles each having a first type of charge and a plurality of black particles each having a second type of charge.

4. The court border module using a display apparatus of claim 1, further comprising a transparent protective layer disposed on the top electrode.

5. The court border module using a display apparatus of claim 1, further comprising a plurality of switches each connecting one of the bottom electrodes and a signal source.

6. The court border module using a display apparatus of claim 5, wherein a polarity of a voltage supplied by the signal source is opposite a polarity of a voltage generated by the piezoelectric elements.

7. The court border module using a display apparatus of claim 5, wherein the switches are transistors.

8. The court border module using a display apparatus of claim 1, wherein the piezoelectric elements are disposed below the bottom electrodes.

9. The court border module using a display apparatus of claim 1, wherein the voltage level is a ground.

* * * * *